United States Patent [19]

Bharteey et al.

[11] Patent Number: 4,539,541

[45] Date of Patent: Sep. 3, 1985

[54] TERMINAL CONNECTOR ASSEMBLY FOR ELECTRIC CONTROL DEVICE

[75] Inventors: Brit M. Bharteey, Bolingbrook, Ill.; Neal E. Rowe, Asheville, N.C.

[73] Assignee: Westinghouse Electric Corp., Pittsburgh, Pa.

[21] Appl. No.: 544,165

[22] Filed: Oct. 21, 1983

[51] Int. Cl.[3] ..... H01H 51/02

[52] U.S. Cl. ..... 335/132; 361/35; 339/263 R

[58] Field of Search ..... 335/132; 361/355, 35, 361/38; 339/263 R

[56] References Cited

U.S. PATENT DOCUMENTS 3,299,378 1/1967 Scheib, Jr. ..... 335/132

*Primary Examiner*—E. A. Goldberg
*Assistant Examiner*—George Andrews

[57] ABSTRACT

There is provided an add-on terminal connector assembly for electric control devices used in motor control centers that eliminates the conductor bends necessary to route incoming conductors to the terminals of a control device which is mounted in the control center.

5 Claims, 3 Drawing Figures

TERMINAL CONNECTOR ASSEMBLY FOR ELECTRIC CONTROL DEVICE

BACKGROUND OF THE INVENTION

1. Field of the Invention

This invention relates generally to an improved terminal connector assembly for an electric control device and more particularly to an electric control device adapted to be mounted in a vertically stacked modular motor control center.

2. Description of the Prior Art

Presently, motor control centers are designed with control devices mounted therein adjacent to a vertically disposed wireway for incoming and outgoing power cables. The terminal lugs on these electric control devices are generally mounted in a vertical position and facing downward. This requires incoming and outgoing cables to make at least two 90° bends within the motor control center for connection to the terminal lug. Making two bends is very difficult in the case of larger cables such as 1/O AWG sizes. It would be desirable if an electric control device were designed to facilitate easier wiring of the devices to minimize unnecessary bends in the power cables within the motor control centers.

SUMMARY OF THE INVENTION

There is provided by this invention a uniquely designed terminal connector assembly that eliminates at least one bend in the associated power cable within the motor control center. This is accomplished by having the cables entering the motor control center compartment go directly to specially-shaped terminal adapters for connection without making upward bends to the control device. In addition, the terminal connector assembly includes an insulating housing which has the capability of accommodating current transformers that are employed for metering purposes.

DESCRIPTION OF THE PREFERRED EMBODIMENT

Figure 1:
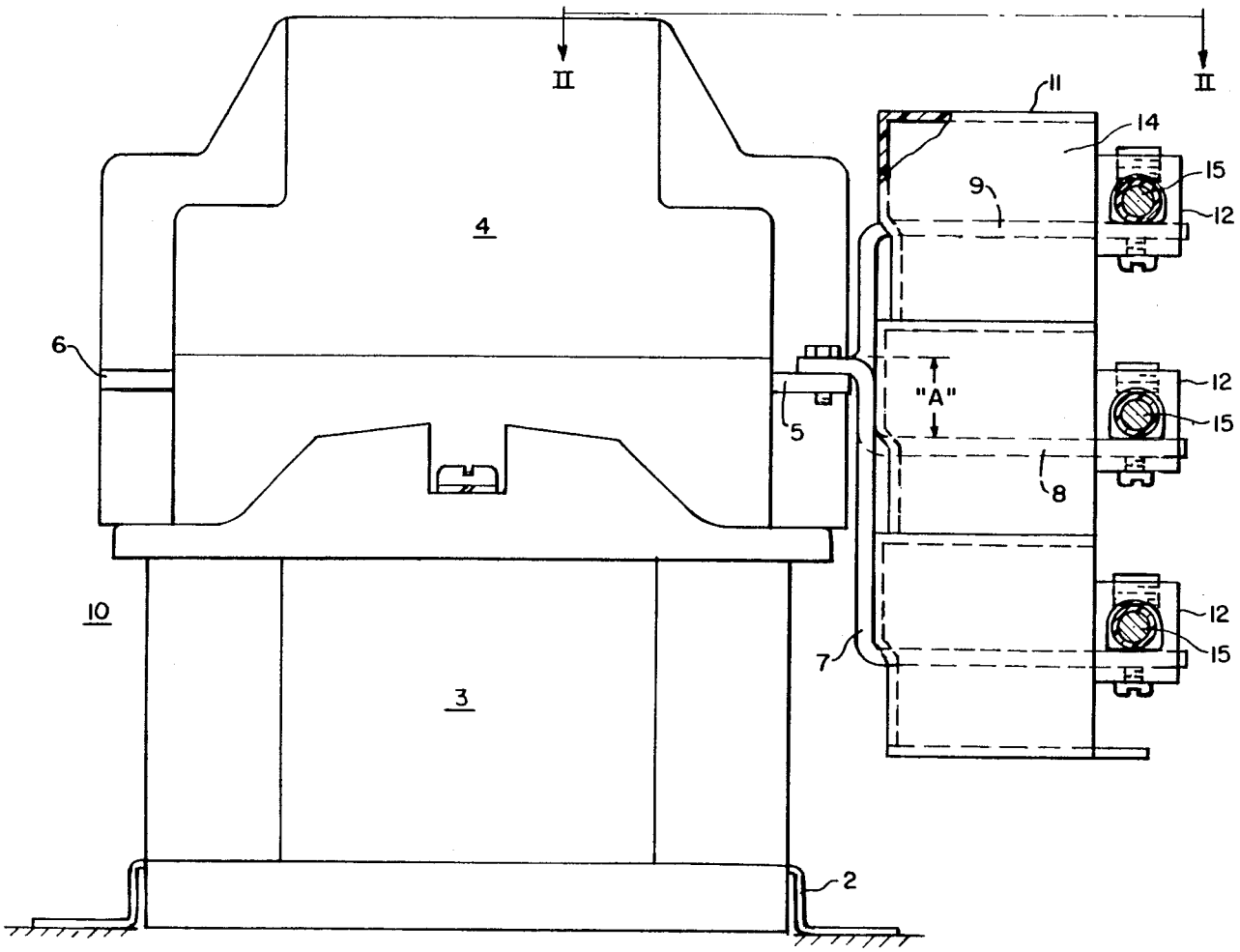
FIG. 1 is a front elevational view of an electric control device incorporating the principles of this invention.
Figure 2:
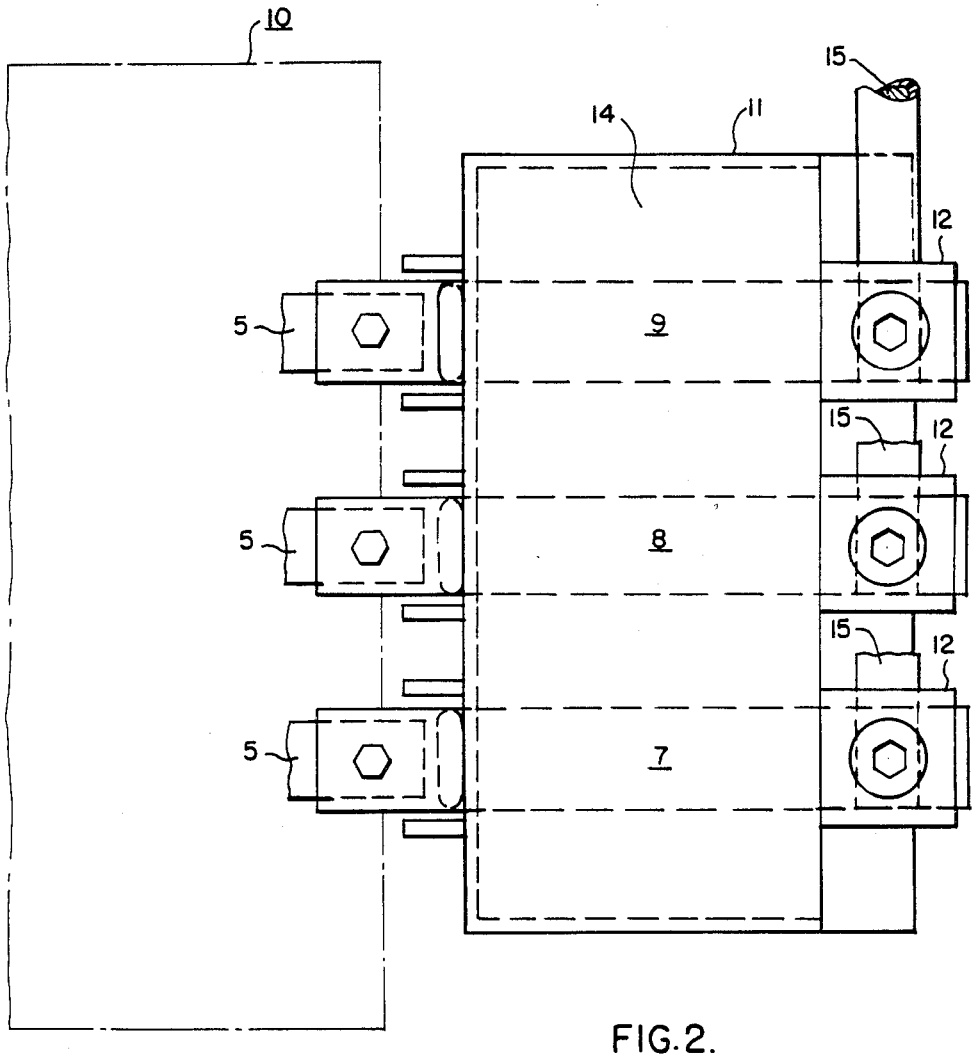
FIG. 2 is an enlarged partial top view along line II—II of FIG. 1 of the terminal connector assembly which embodies the invention.
Figure 3:
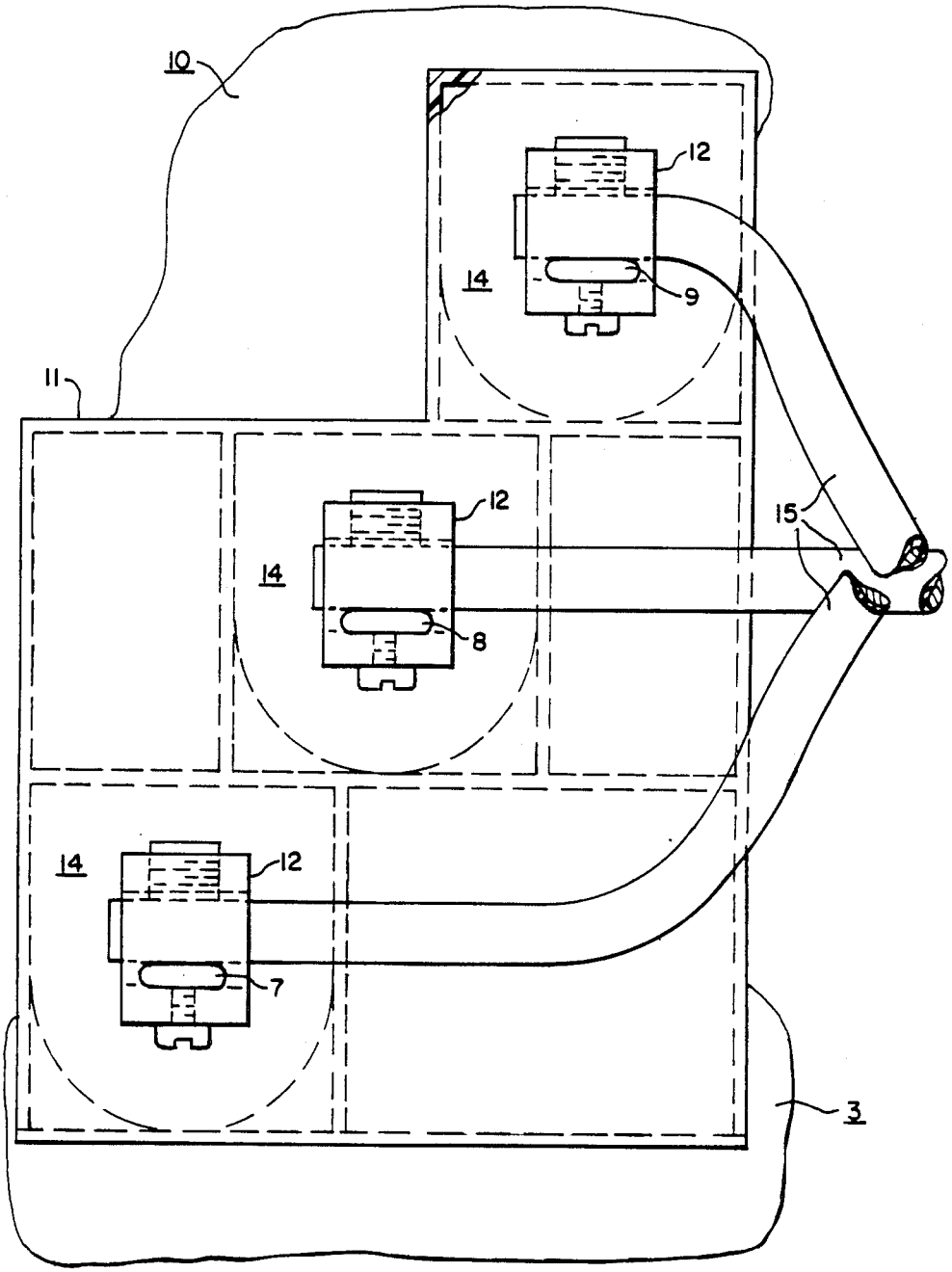
FIG. 3 is an enlarged partial end view illustrating the improved terminal connector assembly and associated lug components shown in FIGS. 1 and 2.

Referring to FIGS. 1–3, there is shown an electric control device 10 of the type disclosed in U.S. Pat. No. 3,296,567 issued to John T. Conner et al. Inasmuch as the detailed description of the electric control device is disclosed in the aforementioned patent, to which reference is made for complete description of structure and operation, the description of those portions is limited to the parts that are essential to the understanding and operation of the invention disclosed herein.

The electric control device 10 is generally comprised of a base 2 and an insulated control device structure comprised of a movable and a stationary contact combination structure 4 that is enclosed and mounted on an electromagnetic operating mechanism 3 for operating said contact combination structure. Terminal straps 5 and 6 for the load side terminals and the line side terminals, respectively, are connected to a stationary contact (not shown) within the contact combination structure 4 and extend from such structure for connecting the current carrying conductors to the control device 10.

According to the principles of this invention, an add-on terminal connector assembly is provided comprising a plurality of terminal adapters 7, 8 and 9 that are attached to the respective load-side terminal straps 5, each of the adapters having a generally "S" shaped configuration and being mounted in an insulating housing 11. These adapters extend downward toward the base 2 and then extend outwardly away from the control device 10, as shown in FIG. 1. Attached to the end of each terminal adapter 7, 8 and 9 are terminal lugs 12 for supporting incoming conductors 15. The terminal adapters 7, 8 and 9 are generally disposed to provide for terminal connections with the incoming conductors at locations away from the electric control device 10 for easier connections, thus eliminating the need for any right angle bends in the conductors in order to couple them to the terminal straps 5 of the electric control device 10. The terminal adapters have different downward extensions (denoted by offset dimension "A" in FIG. 1 for adapter 8) to provide for a generally vertically-spaced arrangement of the respective terminal lugs 12 with sufficient space to allow easier connections. The novel laterally-and-vertically-spaced arrangement provided by the adapter-lug structures of the terminal connector assembly, and the manner in which such arrangement facilitates connection with the respective incoming conductors 15, is best illustrated in FIG. 3. It will also be noted that the insulating housing 11 around each terminal adapter is so constructed that it encloses an associated current transformer 14 used for metering purposes.

Although there a specific embodiment has been illustrated and described, it will be understood that various changes and modifications may be readily made therein by those skilled in the art without departing from the spirit and scope of this invention.

What we claim is:

1. An electric control apparatus comprising:

an enclosed control device structure that includes a movable and stationary contact combination;

an electromechanical means integral with and coupled to said control device structure for operating the movable and stationary contact combination between opened and closed positions;

the movable and stationary contact combination having terminal means that extends from said control device; and a terminal connector assembly comprising an insulating housing having a terminal adapter mounted therein;

said terminal adapter being secured to said terminal means and extending in an outward direction away from said control device and having a terminal lug for securing an incoming electrical conductor to the terminal connector assembly; and said terminal adapter also being of such configuration that the incoming electrical conductor is attached to the terminal connector assembly at a predetermined location that is laterally offset from the terminal means of the control device.

2. The electric control apparatus as recited in claim 1 wherein the terminal adapter has generally an "S"

shaped configuration and is thus adapted to effect a connection with an incoming electric conductor at a location that is both laterally and vertically offset from the terminal means of the control device.

3. The electric control apparatus as recited in claim 2 wherein the insulating housing component of said terminal connector assembly is conformed to accommodate a current transformer therein.

4. The electric control apparatus as recited in claim 2 wherein:

the control device has a plurality of spaced terminal means that extend therefrom and are disposed in substantially the same lateral plane; and the terminal connector assembly has a corresponding number of generally "S" shaped terminal adapters that are secured to and extend from the respective device terminals and through the insulating housing component of said assembly;

said generally "S" shaped terminal adapters having different downward extension dimensions and each being fitted with a terminal lug that is located on the outermost end segment of the associated terminal adapter so that said terminal lugs are vertically and laterally spaced from one another and thereby facilitate the routing and physical arrangement of the incoming electric conductors which are secured to the respective terminal lugs.

5. The electric control apparatus as recited in claim 4 wherein:

the terminal means of said control device comprise strap-like members that extend from the device in the same general direction; and the terminal adapters and terminal lugs are so oriented that the secured ends of the respective incoming electric conductors extend in directions that are transverse relative to said strap-like terminal members.

* * * * *